US006205313B1

(12) United States Patent
Bean

(10) Patent No.: US 6,205,313 B1
(45) Date of Patent: Mar. 20, 2001

(54) TONER CHARGING SYSTEM FOR ATOM IMAGING PROCESS

(75) Inventor: Lloyd F. Bean, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/447,555

(22) Filed: Nov. 23, 1999

(51) Int. Cl.[7] ..... G03G 15/08

(52) U.S. Cl. ..... 399/252; 399/279; 399/285; 399/288

(58) Field of Search ..... 399/252, 258, 399/264, 265, 270, 273, 274, 278, 279, 284, 285, 287, 288, 286; 492/33, 48, 53, 56; 430/49, 307

(56) References Cited

U.S. PATENT DOCUMENTS 3,801,315 * 4/1974 Gundlach et al. ..... 430/307
3,974,554 * 8/1976 Fantuzzo ..... 492/33
4,647,179 3/1987 Schmidlin ..... 399/285
5,339,141 * 8/1994 Suzuki et al. ..... 399/285
5,893,015 4/1999 Mojarradi et al. ..... 399/291
6,049,345 * 4/2000 Nishio et al. ..... 399/284 X

* cited by examiner

*Primary Examiner*—Arthur T. Grimley
*Assistant Examiner*—Hoan Tran
(74) *Attorney, Agent, or Firm*—Oliff & Berridge, PLC

(57) ABSTRACT

Toner charging and/or delivery systems and methods charge and deliver charged toner particles to an image development zone without using carrier particles. Toner particles for imaging process are charged by filling the grooves or cups of a gravure member with uncharged toner particles and charging the toner particles in the grooves or cups using a corona discharge device. The charged toner particles are then transported directly or indirectly to an imaged photoreceptor, where the charged toner particles are used to develop a latent electrostatic image on the imaged photoreceptor. The developed image is then transferred to a copy sheet and permanently fused to the copy sheet.

59 Claims, 6 Drawing Sheets

TONER CHARGING SYSTEM FOR ATOM IMAGING PROCESS

BACKGROUND OF THE INVENTION

1. Field of Invention

The invention relates to a development apparatus for printing apparatuses and machines.

2. Description of Related Art

Generally, electrophotographic printing includes charging a photoconductive member to a substantially uniform potential. This sensitizes the surface of the photoconductive member. The charged portion of the photoconductive surface is then exposed to a light image from either a modulated light source or from light reflected from an original document being reproduced. This creates an electrostatic latent image on the photoconductive surface. After the electrostatic latent image is created on the photoconductive surface, the latent image is developed. Two component and single component developer materials are commonly used to develop the electrostatic latent image.

A typical two component developer comprises magnetic carrier granules and toner particles that adhere triboelectrically to the magnetic carrier granules. In contrast, a single component developer material typically comprises only toner particles. The toner particles are attracted to the latent image recorded on the photoconductive surface to form a developed image on the photoconductive surface. The developed image is then transferred to a copy sheet. Subsequently, the toner powder image is heated to permanently fuse the toner powder image to the copy sheet.

One method to transport toner particles in a development system in a manner that ensures a uniform dispersion of the toner particles on the resulting copy page is through the use of traveling waves. For example, U.S. Pat. No. 4,647,179 to Schmidlin, incorporated herein by reference in its entirety, generates a traveling wave by alternating voltages of three or more phases applied to a linear array of conductors placed about the outer perimeter of a toner particle conveyor. In this development apparatus, the force F for moving the toner particles about the conveyor is equal to $QE_t$, where Q is the charge on the toner particles and $E_t$ is the tangential force supplied by multiphase alternating current voltage applied to the array of conductors.

A magnetic brush supplies toner particles to the conveyor. The magnetic brush rotates in the same direction as the traveling wave. This gives an initial velocity to the toner particles that enables toner particles having a much lower charge to be propelled by the wave sufficiently to reach the charged photoconductor surface.

Another apparatus for transporting charged toner particles in a predetermined path is disclosed in U.S. Pat. No. 5,893,015 to Mojarradi et al., incorporated herein by reference in its entirety. The incorporated 015 patent discloses an apparatus that includes a donor member adapted to move charged particles on its surface in a predetermined path. The donor member includes an electrode array on its outer surface. The electrode array includes a plurality of spaced apart electrodes extending substantially across the width of the surface of the donor member. The 015 patent further discloses a multiphase direct current voltage source operatively coupled to the electrode array. The phases are shifted with respect to each other to create an electrodynamic wave pattern capable of moving charged particles on the surface of the donor member in a predetermined path.

SUMMARY OF THE INVENTION

The disadvantages of two component development systems described above include an inability to consistently control toner particle concentration, a failure to provide uniform mixtures of toner particles and carrier particles, carrier aging problems, and the need to triboelectrically adhere the toner particles to the carrier particles. Furthermore, the carrier particles of two component developer materials produce granularity, i.e., noise, in the resulting image on the copy page. The granularity, or noise, is directly proportional to the size of the carrier particles.

Single component developer materials comprising only toner particles tend to reduce these problems. Additionally, the granularity of the resulting image becomes solely a function of the diameter of the toner particles. However, when using a single component developer material, it becomes difficult to ensure that the toner particles are properly metered out, uniformly charged, and effectively transported in a manner that ensures a uniform dispersion of the toner particles on the resulting copy page.

This invention provides apparatuses, systems and methods that deliver charged toner particles to an image development zone without using carrier particles.

This invention separately provides apparatuses, systems and methods that eliminate the need for toner particle concentration controls in a charged toner particle delivery system.

This invention separately provides charged toner particle delivery systems that have a substantially simplified design.

This invention separately provides charged toner particle delivery systems with no carrier add mix problems, no carrier aging problems, and no carrier tribo matching requirements.

This invention separately provides charged toner particle delivery systems that enable greater simplicity and latitude in developing high-quality images.

This invention separately provides charged toner particle delivery systems that provide a simple, economic single component development (SCD) system and process.

In accordance with the apparatuses, systems and methods of this invention, one exemplary embodiment of the charged toner particle delivery systems according to this invention uses a gravure roll member that is adapted to charge toner particles contained in cups or grooves on its surface. The gravure roll member includes an electrically conductive core having a relaxable coating layer, formed, for example, of urethane, polycarbonate, ceramic, or the like.

The relaxable coating layer acts as an insulator during a toner charging period, and has a relaxation time that allows acquired charges to be dissipated as the gravure roll member rotates through a cycle. In various exemplary embodiments, the relaxable coating layer has a thickness of greater than about five times the toner particle diameter. With this thickness, the major factor determining the polarity and charge value of the individual toner particles becomes the relaxation layer, rather than the toner particle diameter.

The gravure roll member also has toner retaining elements, such as, for example, grooves or cups, on its outer surface. In various exemplary embodiments, the toner retaining elements have a depth less than three times the toner particle diameter. This tends to minimize shadowing of the toner particles during the toner charging step. In various exemplary embodiments, the toner retaining elements have a depth of approximately twice the diameter of the toner particles.

Other exemplary embodiments of this invention include an apparatus that develops a latent image recorded on an imaging surface including a chamber storing a supply of developer material comprising uncharged toner particles, and the gravure roll member described above, spaced from the image surface, and adapted to transport toner particles on the surface of the gravure roll member to a region opposed to the imaging surface.

Other exemplary embodiments of this invention include an electrophotographic image forming machine that develops an electrostatic latent image recorded on an imaging surface of a photoconductive member to form a visible image. The electrophotographic image forming machine includes a housing defining a chamber that stores a supply of developer material, and the gravure roll member described above, spaced from an image surface. The developer material includes uncharged toner particles. The gravure roll member is adapted to transport the toner particles on its surface to a region opposed to the imaging surface.

These and other features and advantages of this invention are described in or are apparent from the following detailed description of various exemplary embodiments of the systems and methods of this invention.

BRIEF DESCRIPTION OF THE DRAWINGS

Various exemplary embodiments of this invention will be described in detail, with reference to the following figures, wherein.

DETAILED DESCRIPTION OF PREFERRED EMBODIMENTS

Figure 1:
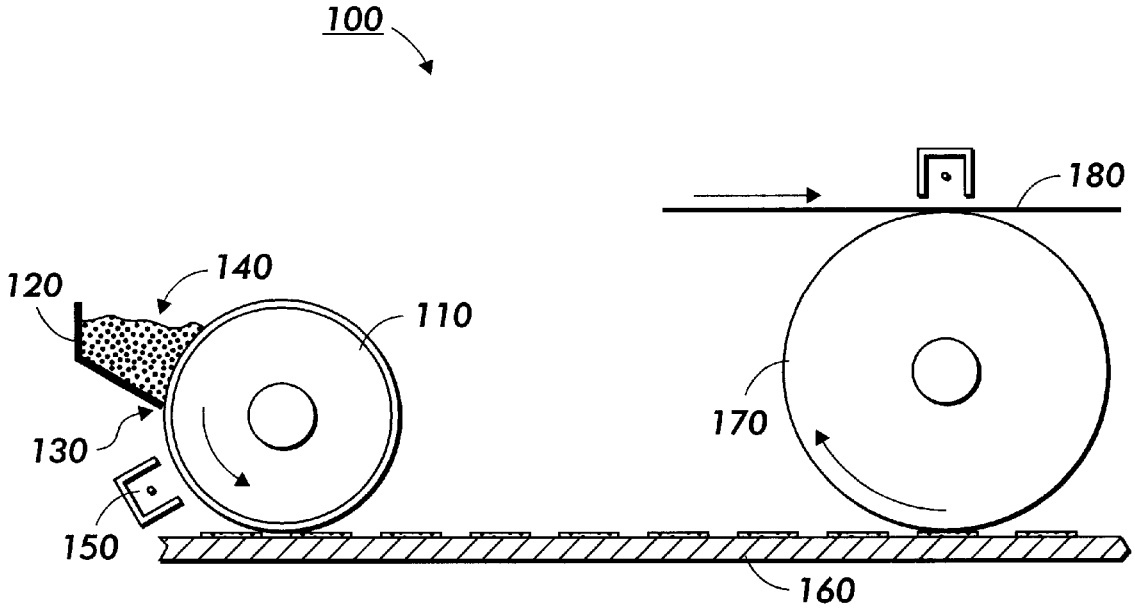
FIG. 1 is a side view of a first exemplary embodiment of a toner charging system according to this invention.
Figure 3:
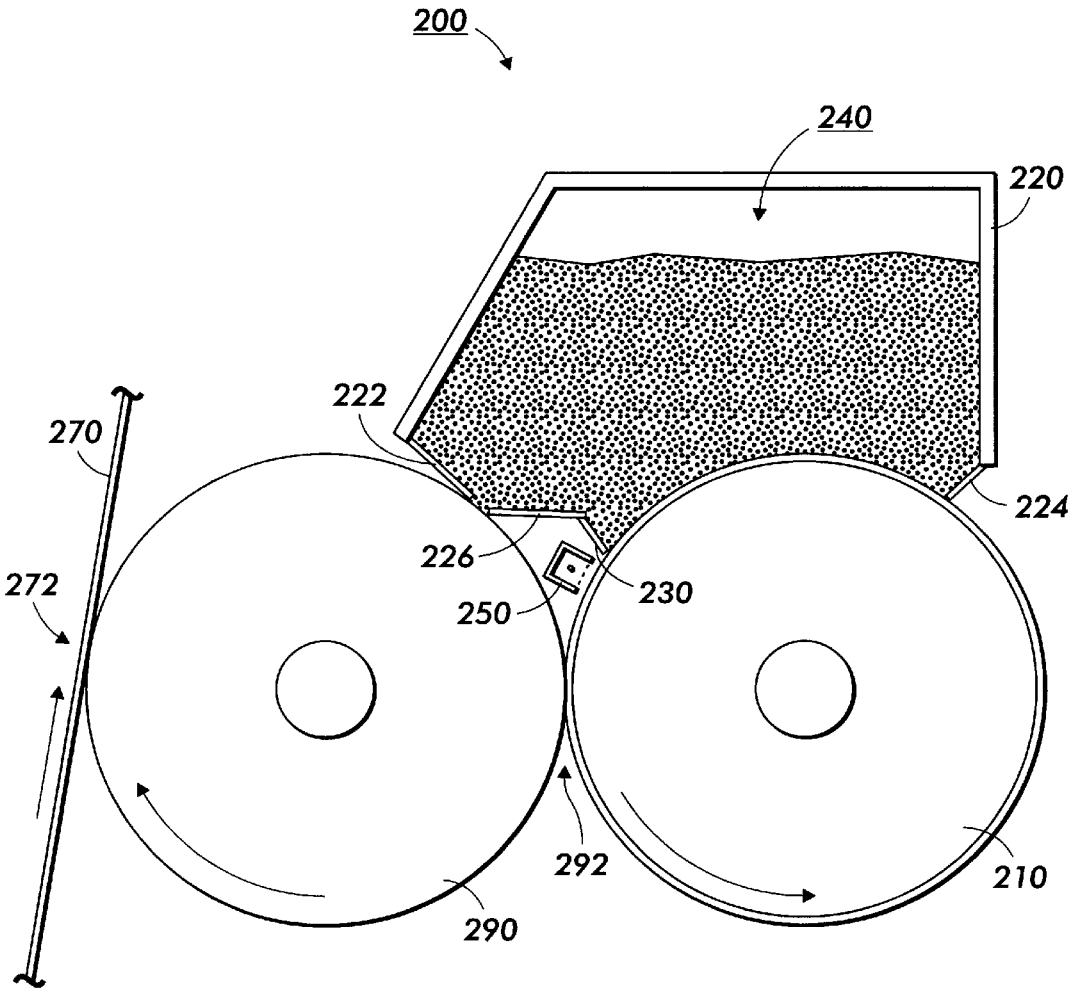
FIG. 3 is a side view of a second exemplary embodiment of a toner charging system according to this invention.
Figure 4:
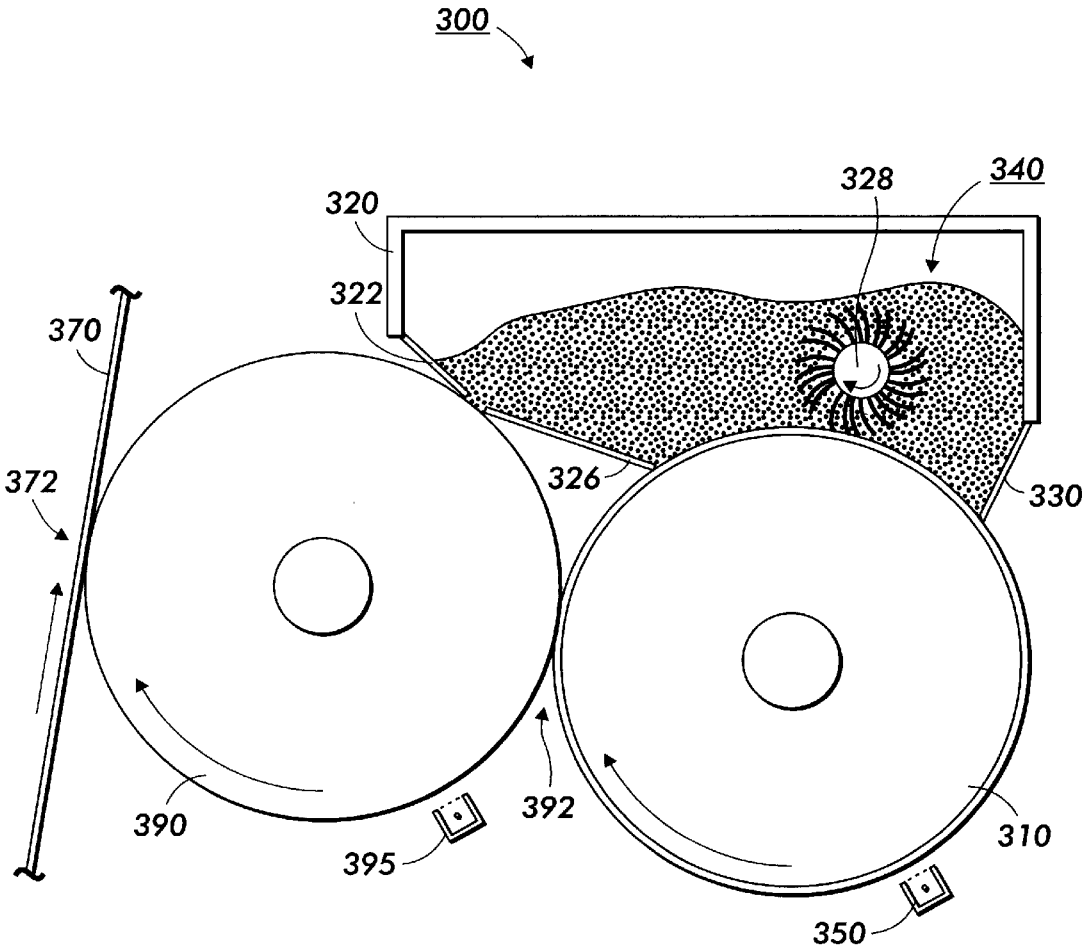
FIG. 4 is a side view of a third exemplary embodiment of a toner charging system according to this invention.

For simplicity and clarification, the operating principles, design factors, and layout of the toner charging system according to the present invention are explained with reference to three exemplary embodiments of a toner charging system according to this invention, as shown in FIGS. 1, 3 and 4. The basic explanation of the operation of the toner charging system is applicable for the understanding and design of the constituent components employed in the toner charging system of this invention.

FIG. 1 shows a first exemplary embodiment of a gravure roll 110 according to this invention. As illustrated in FIG. 1, a first exemplary embodiment of a toner charging system 100 includes the gravure roll member 110, which is rotatably connected to a housing 120. A toner metering blade 130, attached to the housing 120, defines a chamber 140. The chamber 140 stores a supply of uncharged toner particles. A corona discharge device 150 is mounted adjacent to the gravure roll member 110. The corona discharge device 150 charges the uncharged toner particles to a desired potential and polarity. The gravure roll member 110 is positioned adjacent to a traveling electrostatic wave conveyor 160. A photoreceptor 170 is positioned adjacent to the traveling electrostatic wave conveyor 160. It should be appreciated that any other known or later developed toner charging device could be used in place of the corona discharge devices disclosed above.

In various exemplary embodiments, the gravure roll member 110 is mounted 0.005 inches to 0.050 inches above the traveling electrostatic wave conveyor 160. In various exemplary embodiments, the photoreceptor 170 is mounted 0.005 inches to 0.050 inches above the traveling electrostatic wave conveyor 160. The photoreceptor 170 is spaced apart from the gravure roll member 110. The gravure roll member 110 can be rotated in a direction that is either "with" or "against" the direction of motion of the traveling electrostatic wave conveyor 160. Similarly, toner particles on the traveling electrostatic wave conveyor 160 can be traveling in a direction that is "with" or "against" the direction of motion of the photoreceptor 170.

Figure 2:
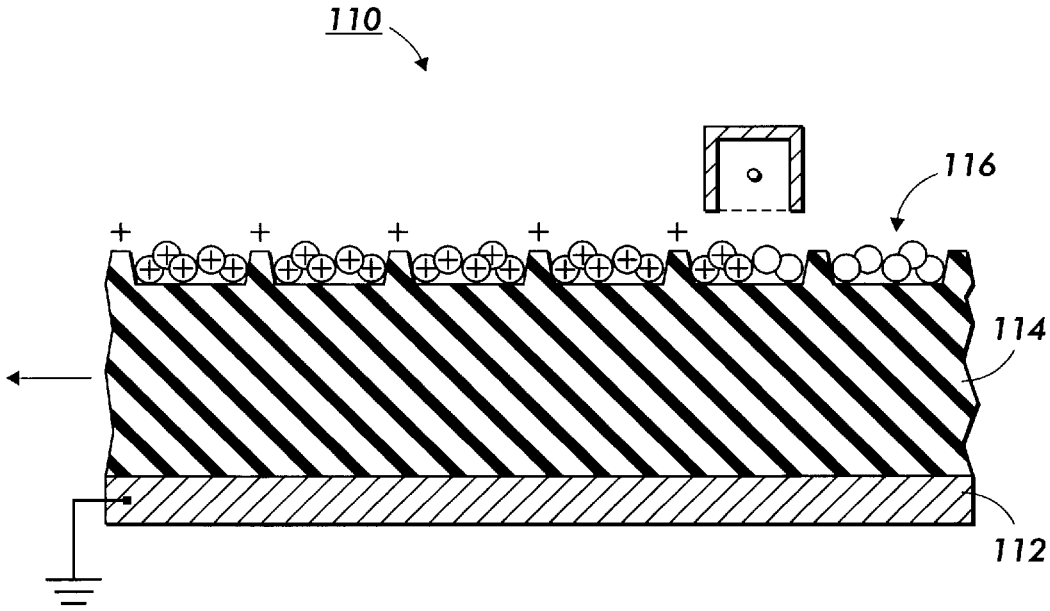
FIG. 2 is a cross-sectional view of the surface of one exemplary embodiment of the gravure roll member according to this invention.

FIG. 2 shows one exemplary embodiment of the gravure roll member 110 in greater detail. As shown in FIG. 2, in various exemplary embodiments, the gravure roll member 110 includes an electrically conductive core 112 having a relaxable coating layer 114 and one or more toner retaining elements 116. In various exemplary embodiments, the relaxable coating layer 114 is formed from one or more of polyurethane, polycarbonate, ceramic, or the like. The relaxable coating layer 114 has a relaxation time that allows acquired charges to be dissipated as the gravure roll member 110 rotates. The relaxable coating layer 114 also acts as an insulator during a toner charging period.

Furthermore, in some exemplary embodiments, the relaxable coating layer 114 has a thickness of greater than five times a toner particle diameter. When the relaxable coating layer 114 has a thickness of greater than five times the toner particle diameter, the major factor determining the polarity and/or the potential of the individual toner particles become the relaxation layer, rather than the toner particle diameter.

The toner retaining elements 116 are formed on the outer surface of the gravure roll member 110. In various exemplary embodiments, the toner retaining elements 116 are grooves, cups or any other known or later developed shape that is capable of holding the toner particles. In various exemplary embodiments, the toner retaining elements 116 have a depth of less than three times the toner particle diameter. In other exemplary embodiments, the toner retaining elements 116 are twice the diameter of the toner particles. Using toner retaining elements 116 of this depth tends to minimize shadowing of toner particles as the toner is charged. In various exemplary embodiments, the toner retaining elements 116 are between 60 degrees and 85 degrees relative to the axis of rotation of the gravure roll member 110.

Figure 2A:
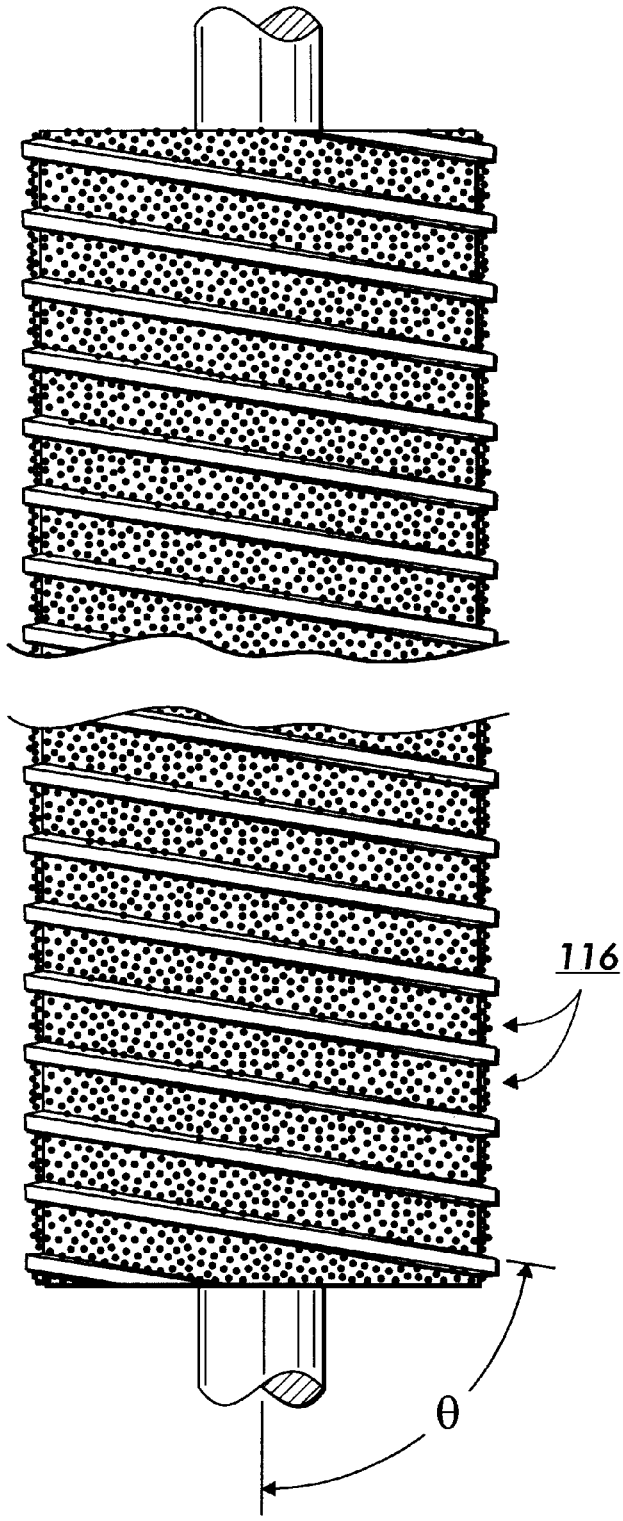
FIG. 2A is a normal view of an angular arrangement of grooves on a surface of a gravure roll member.
Figure 2B:
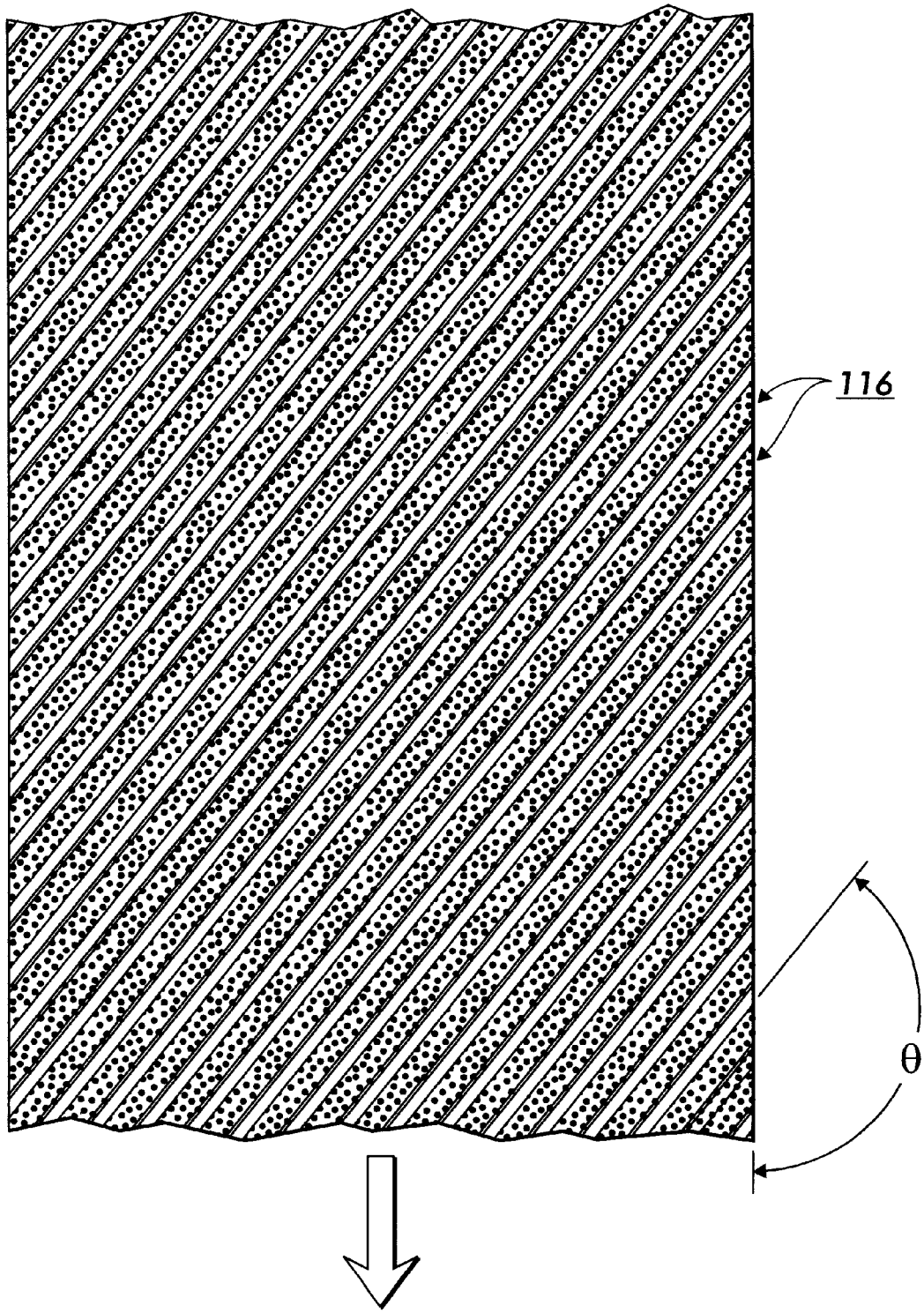
FIG. 2B is a normal view of an angular arrangement of grooves on a surface of a gravure belt member.

Using the toner retaining elements 116 having side walls within this range of angles tends to minimize impacting and sliding of the toner particles as the toner particles are loaded into the toner retaining elements 116. FIGS. 2A and 2B show the toner retaining elements 116 as toner retaining elements grooves on a gravure roll member and a gravure belt member at angle $\phi$.

In other exemplary embodiments, the toner retaining elements 116 include at least two sets of grooves. The at least two sets of grooves are arranged so that a raised area, or island, is created between each pair of adjacent grooves. These raised areas between the grooves maintains the toner metering blade 130 at a uniform height above the surface of the gravure roll member 110.

Referring again to FIG. 1, during operation of the toner charging system 100, as the gravure roll member 110 rotates, uncharged toner particles in the chamber 140 are loaded by gravity into the toner retaining elements 116 on the surface of gravure roll member 110. It should be noted that gravity provides a normal force, with respect to the gravure roll surface, on the toner particles. The normal force of gravity enables toner particles on and near the surface of the gravure roll member 110 to move with the surface of the gravure roll member 110. The movement of the uncharged toner particles on and near the surface of gravure roll member 110 enable the loaded uncharged toner particles into the grooves of the gravure roll member 110 by a toner metering blade 130 positioned on the lower half of the gravure roll member 110.

In various exemplary embodiments, the toner metering blade 130 retards the movement of the toner particles and pushes the toner particles into the toner retaining elements 116 on the surface of gravure roll member 110. In this way, the toner metering blade 130 ensures the toner retaining elements 116 are filled with toner particles even without the aid of the force of gravity.

As the gravure roll member 110 continues to rotate, the toner metering blade 130 removes excess toner particles from the surface of the gravure roll member 110. This leaves a metered amount of toner on the surface of the gravure roll member 110. In various exemplary embodiments, the toner metering blade 130 reduces the amount of toner particles on the surface of the gravure roll to an amount that is based solely and directly on the depth of the toner retaining elements 116.

As the gravure roll member 110 continues to rotate, the uncharged toner particles within the toner retaining elements 116 travel past the corona discharge device 150. The corona discharge device 150 charges the toner particles held within the toner retaining elements 116 to a desired potential and polarity. The relaxable coating layer 114 acts as an insulator between the electrically conductive core 112 and the toner particles during this toner charging period.

Once the toner particles have received the desired amount of charge at the desired polarity, the charged toner particles are electrostatically transferred to the traveling electrostatic wave conveyor 160. As the charged toner particles leave the surface of the gravure roll member 110, the relaxable coating layer 114 allows any charges acquired by the relaxable coating layer 114 on the surface of the gravure roll member 100 during this gravure roll cycle to be dissipated.

The charged toner particles are then transported, via the traveling electrostatic wave conveyor 160, to the imaged photoreceptor 170. The charged toner particles are then electrostatically transferred from the traveling electrostatic wave conveyor 160 to the imaged photoreceptor 170. The photoreceptor 170 then rotates the developed electrostatic image on the photoreceptor 170 to the image transfer/development zone, where the charged toner particles forming the developed image are electrostatically transferred to a copy sheet 180. The toner particles are then permanently fused to the copy sheet 180 to form the output image.

As successive electrostatic latent images are developed, the uncharged toner particles within the chamber 140 are depleted to an undesirable level. A toner dispenser (not shown) stores a supply of toner particles. The toner dispenser communicates with the chamber 140 of the housing 120. As the level of toner particles in the chamber 140 decreases, fresh toner particles are furnished from the toner dispenser. Therefore, a substantially consistent amount of toner particles is maintained in the chamber 140.

FIG. 3 shows a second exemplary embodiment of a toner charging system 200. As illustrated in FIG. 3, the second exemplary toner charging system 200 includes a gravure roll member 210 that is rotatably connected to a housing 220. The housing 220 includes attached "flap/check valve" toner seals 222 and 224, a developer roll member de-toning doctor blade 226, and a toner metering blade 230 that together define a chamber 240. The chamber 240 stores a supply of uncharged toner particles. A corona discharge device 250 is mounted adjacent to the gravure roll member 210. The corona discharge 250 charges the previously uncharged toner particles to a desired potential and polarity.

The gravure roll member 210 is positioned adjacent to a developer roll member 290. In various exemplary embodiments, the gravure roll member 210 is mounted such that the spacing between the gravure roll member 210 and the developer roll member 290 is greater than a gravure roll retaining element period. This tends to improve the possibility that a gravure pattern is not produced on the transferred toner particles on the developer roll member 290. In some exemplary embodiments, the gravure roll retaining element period is approximately 0.005 inches to 0.050 inches. When the spacing between the gravure roll member 210 and the developer roll member 290 is greater than the gravure roll retaining element period a more uniform toner layer can be produced.

The gravure roll member 210 can be rotated in a direction that is either "with" or "against" a direction of motion of the developer roll member 290. A photoreceptor 270 travels tangentially past the developer roll member 290. The developer roll member 290 can be rotated in a direction that is either "with" or "against" a direction of motion of the photoreceptor 270. The gravure roll member 210 includes the electrically conductive core 112, the relaxable coating layer 114 and the toner retaining elements 116 discussed above with respect to FIG. 2.

In various exemplary embodiments, the developer roll member 290 includes a conductive roll with a blade cleanable relaxable coating. In various exemplary embodiments, the blade cleanable relaxable coating is formed of a ceramic material. The relaxable coating layer has a relaxation time that allows acquired charges to be dissipated as developer roll member 290 rotates.

During operation of the toner charging system 200, as the gravure roll member 210 rotates, uncharged toner particles in the chamber 240 are loaded by gravity onto the toner retaining elements 116 on the surface of the gravure roll member 210. As the gravure roll member 210 continues to rotate, the toner metering blade 230 removes excess toner particles from the gravure roll member 210 to leave a metered amount of toner on the surface of the gravure roll member 210.

As described above with respect to FIGS. 1 and 2, the toner metering blade 230 reduces the amount of toner particles on the surface of the gravure roll member 210 based on the depth of the toner retaining elements 116.

As the gravure roll member 210 continues to rotate, the uncharged toner particles within the toner retaining elements 116 travel past the corona discharge device 250, which charges the toner particles held within the toner retaining elements 116 to a desired potential and polarity. The relaxable coating layer 114 acts as an insulator between the electrically conductive core 112 and the toner particles during this toner charging period.

As the gravure roll member 210 continues to rotate, the charged toner particles in the toner retaining elements 116 are electrostatically transferred to the developer roll member 290, which is rotating in a direction opposite to the rotational direction of the gravure roll member 210. The toner particles are electrostatically transferred in a transfer zone 292 by applying an alternating current potential with a direct current bias to either the gravure roll member 210 or the developer roll member 290. As the charged toner particles leave the surface of the gravure roll member 210, the relaxable coating layer 114 allows any charges that were acquired on the surface of gravure roll member 210 during this gravure roll cycle to dissipate.

The charged toner particles are then transported, by the rotating developer roll member 290, towards the imaged photoreceptor 270. In an intermediate transfer zone 272, the charged toner particles are electrostatically transferred from the developer roll member 290 to the photoreceptor 270, which is traveling in a direction that is tangential to the rotational direction of developer roll member 290. Again, the toner particles are electrostatically transferred in the intermediate transfer zone 272 by applying an alternating current potential with a direct current bias to either the developer roll member 290 or the photoreceptor 270.

As the charged toner particles leave the surface of the developer roll member 290, the blade cleanable relaxable coating layer of the developer roll member 290 allows any charges that were acquired on the surface of developer roll member 290 during this transfer cycle to dissipate. As a developer roll member 290 continues to rotate, any undeveloped, residual toner particles left on the developer roll member 290 are removed from the blade cleanable relaxable coating of the developer roll member 290 by the developer roll member de-toning doctor blade 226, and returned to the chamber 240.

The developed photoreceptor 270 then transports the developed image into an image transfer zone (not shown). In this image transfer zone, the charged toner particles of the developed image are electrostatically transferred to a copy sheet and are permanently fused to the copy sheet.

As successive electrostatic latent images are developed, the uncharged toner particles within the chamber 240 are depleted to an undesirable level. A toner dispenser (not shown) stores a supply of toner particles. The toner dispenser communicates with the chamber 240 of the housing 220. As the level of toner particles in the chamber 220 decreases, fresh toner particles are transferred from the toner dispenser. Therefore, a substantially consistent amount of toner particles is maintained in the chamber 240 of the housing 220.

FIG. 4 shows a third exemplary embodiment of a toner charging system 300. As illustrated in FIG. 4, the toner charging system 300 includes a gravure roll member 310 that is rotatably connected to a housing 320. The housing 320 includes an attached "flap/check valve" toner seal 322, a de-toning doctor blade 326, and a toner metering blade 330 that together define a chamber 340. The chamber 340 stores a supply of uncharged toner particles. A toner cleaning/distributing brush 328 is provided within chamber 340. The toner cleaning/distributing brush 328 cleans the surface of gravure roll member 310. In some exemplary embodiments, toner cleaning/distributing brush 328 discharges any charged toner particles that are returned to chamber 340 from either gravure roll member 310 or the developer roll member 390. A corona discharge device 350 is mounted adjacent to the gravure roll member 310. The corona discharge device 350 charges the previously uncharged toner particles to a desired potential and polarity.

The gravure roll member 310 includes the electrically conductive core 112, the relaxable coating layer 114 and the toner retaining elements 116 discussed above with respect to FIG. 2.

The gravure roll member 310 is positioned adjacent to a developer roll member 390. In various exemplary embodiments, the gravure roll member 310 is mounted such that the spacing between the gravure roll member 310 and the developer roll member 390 is greater than a gravure roll retaining element period. This tends to improve the possibility that the gravure pattern is not present in the transferred toner particles on the developer roll member 390. In some exemplary embodiments, the gravure roll retaining element period is approximately 0.005 inches to 0.050 inches. When the spacing between the gravure roll member 310 and the developer roll member 390 is less than the gravure roll retaining element period, a uniform toner layer can be produced.

The gravure roll member 310 can be rotated in a direction that is either "with" or "against" a direction of motion of the developer roll member 390. A second corona discharge device 395 is mounted adjacent to developer roll member 390. The second corona discharge device 395 optimizes the potential and polarity of the charged toner particles. In some exemplary embodiments, the second corona discharge device 395 narrows the toner charge distribution on the top-most toner particles on the developer roll member 390. A photoreceptor 370 travels tangentially passed the developer roll member 390. The developer roll member 390 can be rotated in a direction that is either "with" or "against" a direction of motion of the photoreceptor 370.

In various exemplary embodiments, the developer roll member 390 includes a conductive roll with a blade cleanable relaxable coating. In various exemplary embodiments, the blade cleanable relaxable coating is formed of a ceramic material. The relaxable coating layer has a relaxation time that allows acquired charges to be dissipated as the developer roll member 390 rotates.

During operation of the toner charging system 300, as gravure roll member 310 rotates, uncharged toner particles in the chamber 340 are loaded by gravity into the toner retaining elements 116 on the surface of gravure roll member 310. As the gravure roll member 310 continues to rotate, the toner metering blade 330 removes excess toner particles from gravure roll member 310 to leave a metered amount of toner on the surface of gravure roll member 310. As described above with respect to FIGS. 1 and 2, the toner metering blade 330 reduces the amount of toner particles on the surface of the gravure roll member 310 based on the depth of the toner retaining elements 116.

As the gravure roll member 310 continues to rotate, the uncharged toner particles within the toner retainer elements 116 travel past the corona discharge device 350. The corona discharge device 350 charges the toner particles held within the toner retaining elements 116 to a desired potential and polarity. The relaxable coating layer 114 acts as an insulator between the electrically conductive core 112 and the toner particles during this toner charging period.

As the gravure roll member 310 continues to rotate, the charged toner particles in the toner retaining elements 116 are electrostatically transferred from the gravure roll member 310 to the developer roll member 390. The developer roll 390 rotates in the same rotational direction as the rotational direction of the gravure roll member 210. The toner particles are electrostatically transferred in a transfer zone 392 by applying an alternating current potential with a direct current bias to either the gravure roll member 310 or the developer roll member 390. As the charged toner particles leave the surface of the gravure roll member 310, the relaxable coating layer 114 allows any charges that were acquired on the surface of gravure roll member 210 during this gravure roll cycle to dissipate.

As the developer roll member 390 continues to rotate, the charged toner particles on the surface of developer roll member 390 travel past the second corona discharge device 395. The second corona discharge device 395 optimizes the potential and polarity of the charged toner particles. In various exemplary embodiments, the second corona discharge device 395 narrows the toner charge distribution on the topmost toner particles on the developer roll member 390.

The charged toner particles are then transported, by the rotating developer roll member 390, towards the imaged photoreceptor 370. In an intermediate transfer zone 372, the charged toner particles are electrostatically transferred from the developer roll member 390 to the photoreceptor 370. The photoreceptor 370 travels in a direction that is tangential to the rotational direction of the developer roll member 390. Again, the toner particles are electrostatically transferred by applying an alternating current potential with a direct current bias to either the developer roll member 390 or the photoreceptor 370. As the charged toner particles leave the surface of the developer roll member 390, the blade cleanable relaxable coating layer of the developer roll member 390 allows any charges that were acquired on the surface of the developer roll member 390 during this transfer cycle to dissipate. As the developer roll member 390 continues to rotate, any undeveloped, residual toner particles left on the developer roll member 390 are removed from the blade cleanable relaxable coating of the developer roll member 390 by the developer roll member de-toning doctor blade 326, and returned to the chamber 340.

The developed photoreceptor 370 then transports the developed image into an image transfer zone (not shown), where the charged toner particles of the developed image are electrostatically transferred to a copy sheet and are permanently fused to the copy sheet.

As successive electrostatic latent images are developed, the uncharged toner particles within the chamber 340 are depleted to an undesirable level. A toner dispenser (not shown) stores a supply of toner particles. The toner dispenser communicates with the chamber 340 of the housing 320. As the level of toner particles in the chamber 320 decreases, fresh toner particles are furnished from the toner dispenser. Therefore, a substantially consistent amount of toner particles is maintained in the chamber 340 of the housing 320.

In the various exemplary embodiments described above, for example, the charged toner particles are electrostatically transferred from the gravure roll member to either a traveling electrostatic wave conveyor or a developer roll member. Alternatively, the charged toner particles can be electrostatically transferred from the gravure roll member to a flexible donor belt employing a dc traveling wave as disclosed in the incorporated 015 patent.

It should be appreciated that any other known or later developed toner charging device could be used in place of the corona discharge devices disclosed above.

Additionally, the toner charging system disclosed herein has been described with reference to a gravure roll member. However, it should be appreciated that any known or later developed gravure member, including but not limited to a gravure belt member, could be modified to incorporate the toner charging systems and methods described herein.

Furthermore, the toner charging system disclosed herein has been described within a single color electrophotographic marking process. However, it should be appreciated that any known or later developed image forming system that uses a powder toner could be modified to incorporate the toner charging systems and methods described herein.

While this invention has been described in conjunction with the exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A toner particle charging apparatus, comprising:

a chamber that stores a supply of uncharged toner particles;

a gravure member, the gravure member movable relative to the chamber, the gravure member having toner retaining elements formed on a surface of the gravure member, the toner retaining elements formed to hold a precise amount of toner particles;

a toner metering blade that limits an amount of toner particles distributed on the surface of the gravure member to that which is contained in the toner retaining elements; and a corona discharge device that charges the previously uncharged toner particles on the gravure member to a desired voltage and polarity.

2. The toner particle charging apparatus of claim 1, wherein the toner retaining elements are grooves formed on the surface of the gravure member.

3. The toner particle charging apparatus of claim 2, wherein the gravure member is one of a gravure roll member or a gravure belt member.

4. The toner particle charging apparatus of claim 3, wherein the grooves of the gravure roll member are at an angle of between 60 degrees and 85 degrees relative to the angle of rotation of the gravure roll member.

5. The toner particle charging apparatus of claim 3, wherein the grooves of the gravure roll member are at an angle of 75 degrees relative to the angle of rotation of the gravure roll member.

6. The toner particle charging apparatus of claim 1, wherein the gravure member includes an electrically conductive core.

7. The toner particle charging apparatus of claim 1, wherein the gravure member includes a relaxable coating layer.

8. The toner particle charging apparatus of claim 1, wherein the toner retaining elements include at least two sets of grooves.

9. The toner particle charging apparatus of claim 8, wherein the at least two sets of grooves are oriented such that there is a raised space between at least one pair of the at least two sets of grooves.

10. The toner particle charging apparatus of claim 1, wherein the toner retaining elements are cups formed on the surface of the gravure member.

11. The toner particle charging apparatus of claim 1, wherein the toner retaining elements have a depth at most approximately three times a toner particle diameter.

12. The toner particle charging apparatus of claim 1, wherein the chamber includes a toner cleaning/distributing brush.

13. The toner particle charging apparatus of claim 1, wherein the toner metering blade is fixedly attached to the housing.

14. An imaging forming apparatus, comprising the toner particle charging apparatus of claim 1.

15. The imaging forming apparatus of claim 14, wherein the image forming apparatus is one of a laser printer; a xerographic copier; an analog copier; a digital copier; a color copier; or a color printer.

16. The imaging forming apparatus of claim 14, comprising at least one of at least one photoconductive drum element or at least one photoconductive belt member.

17. A toner particle charging apparatus, comprising:

a chamber that stores a supply of uncharged toner particles;

a gravure belt member, the gravure belt member movable relative to the chamber, the gravure belt member having toner retaining grooves formed on a surface of the gravure belt member;

a toner metering blade that limits an amount of toner particles distributed on the surface of the gravure belt member; and a corona discharge device that charges the previously uncharged toner particles distributed on the surface of the gravure belt member to a desired voltage and polarity, wherein the grooves of the gravure belt member are at an angle of between 150° and 175° relative to the process direction of the gravure belt member.

18. A toner particle charging apparatus, comprising:

a chamber that stores a supply of uncharged toner particles;

a gravure belt member, the gravure belt member movable relative to the chamber, the gravure belt member having toner retaining elements formed as grooves on a surface of the gravure belt member;

a toner metering blade that limits an amount of toner particles distributed on the surface of the gravure belt member; and a corona discharge device that charges the previously uncharged toner particles distributed on the surface of the gravure belt member to a desired voltage and polarity, wherein the grooves of the gravure belt member are at an angle of 165° relative to the process direction of the gravure belt member.

19. A toner particle charging apparatus, comprising:

a chamber that stores a supply of uncharged toner particles;

a gravure member, the gravure member movable relative to the chamber, the gravure member having a relaxable coating layer and toner retaining elements formed on a surface of the gravure member;

a toner metering blade that limits an amount of toner particles distributed on the surface of the gravure member; and a corona discharge device that charges the previously uncharged toner particles distributed on the surface of the gravure belt member to a desired voltage and polarity, wherein the relaxable coating layer acts as an insulator during a toner charging period.

20. The toner particle charging apparatus of claim 19, wherein the relaxable coating layer has a relaxation time that allows acquired charges in a gravure member cycle to be dissipated.

21. The toner particle charging apparatus of claim 19, wherein the relaxable coating layer has a thickness of at least approximately five times a toner particle diameter.

22. A charged toner delivery system, comprising:

a chamber that stores a supply of uncharged toner particles;

a gravure member, the gravure member movable relative to the chamber, the gravure member having at least one toner retaining element formed on a surface of the gravure member, the toner retaining elements formed to hold a precise amount of toner particles;

a toner metering blade that limits an amount of toner particles distributed on the surface of the gravure member to that which is contained in the toner retaining elements; and a corona discharge device that charges the previously uncharged toner particles on the gravure member to a desired voltage and polarity.

23. The charged toner delivery system of claim 22, wherein the toner retaining elements are grooves formed on the surface of the gravure member.

24. The charged toner delivery system of claim 23, wherein the gravure member is one of a gravure roll member or a gravure belt member.

25. The charged tower delivery system of claim 24, wherein the grooves of the gravure roll member are at an angle of between 60 degrees and 85 degrees relative to the angle of rotation of the gravure roll member.

26. The charged tower delivery system of claim 24, wherein the grooves of the gravure roll member are at an angle of 75 degrees relative to the angle of rotation of the gravure roll member.

27. The charged toner delivery system of claim 24, wherein the gravure member includes an electrically conductive core.

28. The charged toner delivery system of claim 24, wherein the gravure member includes a relaxable coating layer.

29. The charged toner delivery system of claim 24, wherein the toner retaining elements include at least two sets of grooves.

30. The charged toner delivery system of claim 29, wherein the at least two sets of grooves are oriented such that there is a raised space between at least one pair of the at least two sets of grooves.

31. The charged toner delivery system of claim 24, wherein the toner retaining elements are cups formed on the surface of the gravure member.

32. The charged toner delivery system of claim 24, wherein the toner retaining elements have a depth at most approximately three times a toner particle diameter.

33. The charged toner delivery system of claim 24, wherein the chamber includes a toner cleaning/distributing brush.

34. The charged toner delivery system of claim 24, wherein the toner metering blade is fixedly attached to the housing.

35. An imaging forming apparatus, comprising the charged toner delivery system of claim 24.

36. The imaging forming apparatus of claim 35, wherein the image forming apparatus is one of a laser printer; a xerographic copier; an analog copier; a digital copier; a color copier; or a color printer.

37. The imaging forming apparatus of claim 35, comprising at least one of at least one photoconductive drum element and at least one photoconductive belt member.

38. A charged toner particle delivery system, comprising:

a chamber that stores a supply of uncharged toner particles;

a gravure belt member, the gravure belt member moveable relative to the chamber, the gravure belt member having grooves as toner retaining elements formed on a surface thereof;

a toner metering blade that limits an amount of toner particles distributed on the surface of the gravure belt member; and a corona discharge device that charges the previously uncharged toner particles on the gravure belt member to a desired voltage and polarity, wherein the grooves of the gravure belt member are at an angle of between 150 degrees and 75 degrees relative to the process direction of the gravure belt member.

39. A charged toner particle delivery system, comprising:

a chamber that stores a supply of uncharged toner particles;

a gravure belt member, the gravure belt member moveable relative to the chamber, the gravure belt member having grooves as toner retaining elements formed on a surface thereof;

a toner metering blade that limits an amount of toner particles distributed on the surface of the gravure belt member; and a corona discharge device that charges the previously uncharged toner particles on the gravure belt member to a desired voltage and polarity;

wherein the grooves of the gravure belt member are at an angle of 165 degrees relative to the process direction of the gravure belt member.

40. A charged toner delivery system, comprising:

a chamber that stores a supply of uncharged toner particles;

a gravure member, the gravure member movable relative to the chamber, the gravure member having a relaxable coating layer and toner retaining elements formed as grooves on a surface of the gravure member;

a toner metering blade that limits an amount of toner particles distributed on the surface of the gravure member; and a corona discharge device that charges the previously uncharged toner particles distributed on the surface of the gravure member to a desired voltage and polarity;

wherein the relaxable coating layer acts as an insulator during a toner charging period.

41. The charged toner delivery system of claim 40, wherein the relaxable coating layer has a relaxation time that allows acquired charges in a gravure member cycle to be dissipated.

42. The charged toner delivery system of claim 40, wherein the relaxable coating layer has a thickness of at least approximately five times the toner particle diameter.

43. A method for charging uncharged toner particles, comprising:

supplying the uncharged toner particles to a gravure member in a precise amount;

charging the toner particles on the gravure member to a desired potential and polarity; and delivering the charged toner particles to one of at least a gravure member and a development photoreceptor.

44. The method of claim 43, wherein the gravure member is one of a gravure roll member or a gravure belt member.

45. The method of claim 43, wherein supplying the uncharged toner particles to the gravure member comprises providing the toner particles to toner retaining elements of the gravure member.

46. The method of claim 45, wherein providing the toner particles to the toner retaining elements includes loading uncharged toner particles by gravity from a chamber storing the supply of uncharged toner particles.

47. The method of claim 43, wherein supplying the uncharged toner particles to the gravure member in a precise amount comprises supplying the uncharged toner particles to the gravure member such that the uncharged particles form a layer having a depth of approximately three toner particles on the surface of the gravure member.

48. The method of claim 43, wherein delivering the charged toner particles includes transporting the charged toner particles to an image development zone.

49. The method of claim 48, wherein transporting the charged toner particles comprises energizing electrostatic traveling waves to transport the charged toner particles.

50. The method of claim 48, wherein transporting the charged toner particles comprises rotating a donor member that is adapted to move charged particles on the surface of the donor member in a predetermined path.

51. The method of claim 43, wherein delivering the charged toner particles comprises applying an electrical bias to electrostatically transfer the charged toner particles from the gravure member.

52. The method of claim 43, wherein delivering the charged toner particles includes transferring the charged toner particles from an image development zone to a copy sheet.

53. The method of claim 43, wherein delivering the charged toner particles includes fusing the charged toner particles to a copy sheet.

54. The method of claim 43, wherein delivering the charged toner particles includes allowing acquired charges in a gravure member cycle to be dissipated.

55. The method of claim 43, wherein supplying the uncharged toner particles includes filling toner retaining elements on the surface of the gravure member.

56. The method of claim 55, wherein the toner retaining elements have a depth of at most approximately three times a toner particle diameter.

57. A method for charging uncharged toner particles, comprising:

supplying the uncharged toner particles to a gravure member;

removing excess uncharged toner particles from the gravure member;

charging the toner particles on the gravure member to a desired potential and polarity; and delivering the charged toner particles to one of at least a gravure member and a development photoreceptor, wherein delivering the charged toner particles includes allowing acquired charges in a gravure member cycle to be dissipated through a relaxable coating layer.

58. The method of claim 57, wherein the relaxable coating layer has a thickness of at least approximately five times a toner particle diameter.

59. A method for charging uncharged toner particles, comprising:

supplying the uncharged toner particles to a gravure member;

removing excess uncharged toner particles from the gravure member;

charging the toner particles on the gravure member to a desired potential and polarity; and delivering the charged toner particles to one of at least a gravure member and a development photoreceptor, wherein delivering the charged toner particles includes preventing charges on the charged toner particles from dissipating the gravure member during a toner charging period.

* * * * *